US006311351B1

(12) United States Patent
Murphy

(10) Patent No.: US 6,311,351 B1
(45) Date of Patent: Nov. 6, 2001

(54) PRESSURE REDUCING MATTRESS WITH LOCALIZED PRESSURE POINT RELIEF

(75) Inventor: Michael Murphy, LaCrosse, WI (US)

(73) Assignee: Comfortex Health Care Surfaces, MN (US)

( * ) Notice: Subject to any disclaimer, the term of this patent is extended or adjusted under 35 U.S.C. 154(b) by 0 days.

(21) Appl. No.: 09/359,808

(22) Filed: Jul. 23, 1999

(51) Int. Cl.[7] ..... A47C 27/15
(52) U.S. Cl. ..... 5/727; 5/740; 5/657
(58) Field of Search ..... 5/727, 728, 729, 5/730, 740, 657

(56) References Cited

U.S. PATENT DOCUMENTS 3,521,311 * 7/1970 Cohen ..... 5/727
3,604,025 * 9/1971 Mims ..... 5/730
3,846,857 * 11/1974 Weinstock ..... 5/727
4,335,476 * 6/1982 Watkin ..... 5/730
5,231,717 * 8/1993 Scott et al. ..... 5/727
5,513,402 * 5/1996 Schwartz ..... 5/727 X
5,953,779 * 9/1999 Schwartz ..... 5/727 X

* cited by examiner

*Primary Examiner*—Lynne H. Browne
*Assistant Examiner*—Fredrick Conley

(57) ABSTRACT

A pressure point relief system for use in a patient resting surface, such as a mattress, that has different firmness ratings in different areas of the surface of the mattress which correspond to different points of a patient's body. The pressure point relief device has at least one first foam strip of a predetermined firmness, and at least one second foam strip having a firmness greater than that of the first foam strip and positioned adjacent to the first foam strip so as to form a smooth transition from a surface of the first foam strips to a surface of the second foam strips. In addition, at least one foam truss portion is positioned adjacent to the first and second foam strips so as to provide a smooth transition from the surface of the first and second foam strips to a surface of the truss system thereby forming a substantially planar surface. The substantially planar surface of the pressure point relief system has different firmness ratings in different areas of the planar surface which correspond to different points of the patient's body.

8 Claims, 1 Drawing Sheet

PRESSURE REDUCING MATTRESS WITH LOCALIZED PRESSURE POINT RELIEF

BACKGROUND OF THE INVENTION

1. Field of the Invention

This invention concerns mattresses used in the field of health care to provide pressure reduction for the patient. The invention more particularly concerns mattresses for providing adequate pressure point relief to sensitive areas of the patient's body.

2. Discussion of the Background

Conventional mattresses have a number of shortcomings which can result in discomfort and prolonged recovery period for the patient Ideally, mattresses provide the lowest possible pressure on the supported surface of the patient and are able to substantially eliminate the pressure on the supported surface at selected locations on the patient which are most susceptible to pressure sores.

There are a number of devices that reduce pressure to safe levels for patients in bed, but very few that provide adequate reduction and pressure point relief for sensitive areas. Moreover, other surfaces that relieve pressure to levels that restore blood flow and encourage wound healing are usually mechanical laden beds or air floatation mattresses of great expense.

Thus, there is a need for a mattress that is inexpensive and simple in construction, and which also provides substantially uniform pressure on the support surface of a patient's body as well as localized pressure point relief for sensitive areas of the patient's body.

SUMMARY OF THE INVENTION

It is an object of the invention to provide a cushioning device that is inexpensive and simple in construction, and that also applies a substantially uniform pressure to the supported surface of a patient's body as well as localized pressure point relief for sensitive areas of the patient's body.

In one form of the invention the substantially uniform pressure and localized reduced pressure is provided by a pressure point relief system having at least one first foam strip of a predetermined firmness and at least one second foam strip having a firmness greater than that of the first foam strip and positioned adjacent to the first foam strip so as to provide a smooth transition from a surface of the first foam strip to a surface of the second foam-like strip. In addition, at least one foam truss portion is positioned adjacent to the first and second foam strips so as to provide a smooth transition from the surface of the first and second foam strips to a surface of the truss system thereby forming a substantially planar surface having different firmnesses in different areas of the planar surface which correspond to different points of the patient's body.

In another form of the pressure point relief system, the foam truss portion comprises a piece of foam material having a plurality of cut-outs that extend there-through in a direction perpendicular to the planar surface.

In yet another form of the pressure point relief system, the first foam strip has a firmness of about 8–14 IFD, the second foam strip has a firmness rating of about 27–33 IFD and the truss system has a firmness of about 15–21 IFD.

In still another form of the invention, the substantially uniform pressure and localized reduced pressure is provided in a localized pressure point relief mattress. The mattress has a base layer and a pressure point relief layer attached to a top side of the base layer and having a first foam-like strip of a predetermined firmness centered between and in smooth surface transition with two second foam strips having a firmness greater than that of the first foam strip, the pressure point relief layer sized and positioned so as to be aligned with the base layer. A truss portion abutting an edge of the aligned base layer and pressure point relief layer is provided so as to form a substantially planar top surface and a perimeter to which is attached a sidewall portion so as to form a substantially planar mattress surface. A cushion portion is then positioned to substantially cover the mattress surface.

In another form of the mattress, the cushion portion is made of an intermediate layer in direct contact with the mattress surface and having a firmness of about 11–15 IFD, and a top layer attached to the intermediate layer and having a firmness of about 4–10 IFD.

In yet another form of the mattress, the sidewall portion has a firmness of about 60 IFD.

Thus Applicant's invention provides a cushioning device having a substantially planar surface and variable firmnesses in different areas of the planar surface that correspond to sensitive areas of the patient's body. This inexpensive and simple construction applies a substantially uniform pressure to the supported surface of a patient's body while also providing localized pressure point relief for sensitive areas of the patient's body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
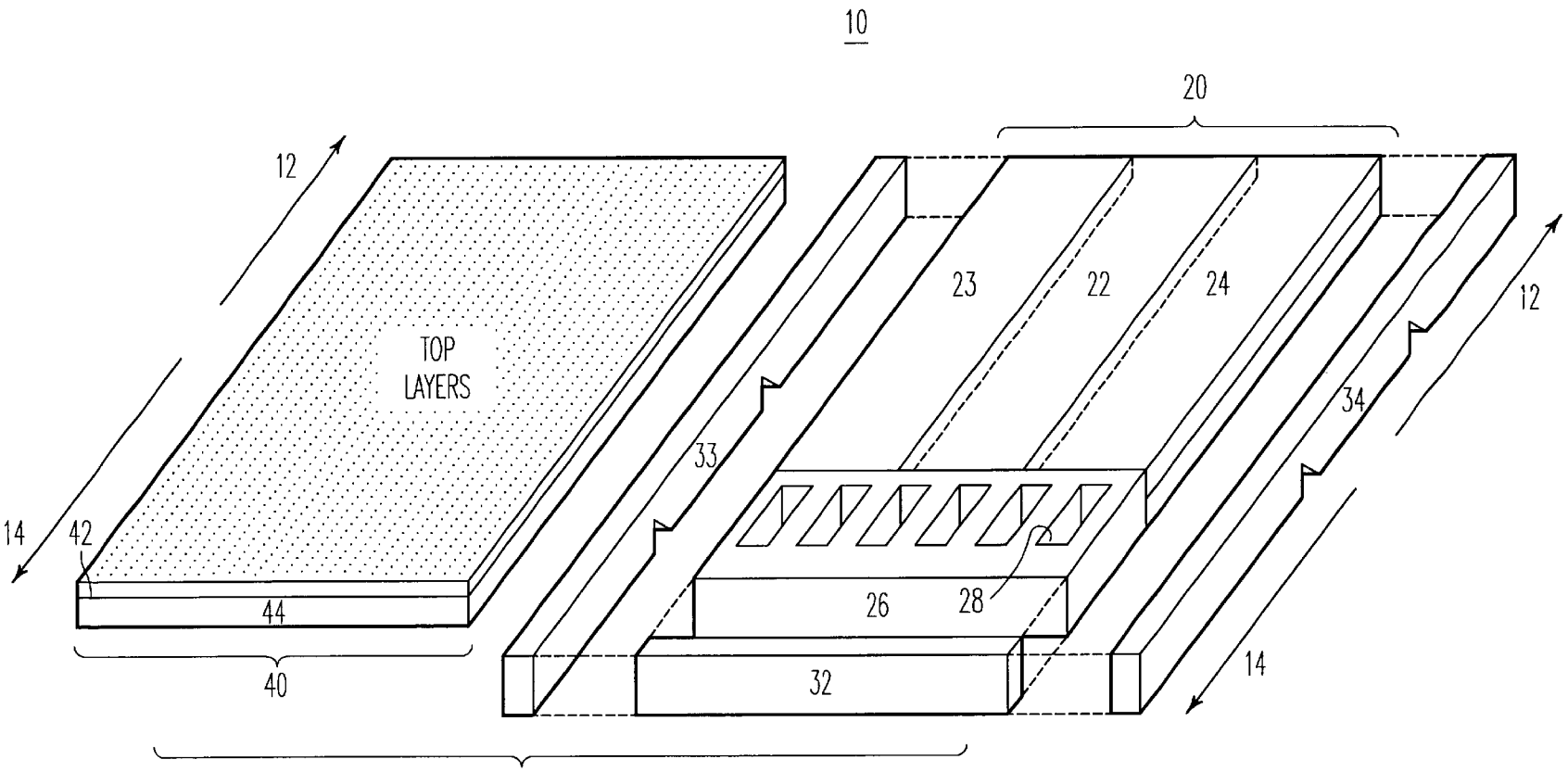
FIG. 1 is a perspective view of a mattress with the foam outer layers removed and with the ridged sidewalls removed showing the pressure point relief layer, the truss system, and the mattress base layer.

Referring now to the drawing, a mattress 10 has been created which is inexpensive and simple in construction and also provides for pressure reduction and selective pressure point relief on the surface of the patient. The embodiment of this invention is displayed in FIG. 1 which is a perspective view of the mattress with the top cushioning assembly 40 removed and with the ridged foam sidewalls 32, 33, and 34 removed, showing the pressure point relief assembly 20.

The mattress 10 has a head portion and a foot portion as indicated by arrows 12 and 14 respectively in the figure. The mattress is made up of a pressure point relief assembly 20 which is bordered by foot side support 32, left side support 33 and right side support 34. The top cushioning assembly 40 then covers pressure point relief assembly 20 and accompanying side supports 32, 33 and 34. The mattress design is encased in a waterproof nylon and vinyl cover (not shown) which makes it suitable for healthcare use. These covers are commonly used in the art and typically include a means for removal and replacement of the cover, such as a zipper.

The pressure point relief assembly 20 is made up of a base layer 25, the top side of which is attached to a soft strip 22, left firm panel 23 and right firm panel 24. The soft strip 22 and the firm panels 23 and 24 are laminated atop the base layer 25 such that the soft strip 22 is in the middle of the base layer 25 and the left panel 23 and right panel 24 are in lateral abutment with respective sides of the soft strip 22. The soft strip 22, and firm panels 23 and 24 are sized, shaped and arranged relative to the base layer 25 so as to form a substantially planar top surface and a common perimeter with the base layer 25. The foot end 14 of such common perimeter is attached to a truss system 26 such that the top surface of the truss system 26 is in smooth transition with the top planar surface formed by the soft strip 24, and firm panels 23 and 24. The truss system is sized, shaped and arranged such that when attached to the soft strip 22 and firm panels 23 and 24, the truss system 26 extends the common perimeter and substantially planar top surface of the soft strip 22, and firm panels 23 and 24, to form the foot end 14 of the mattress 10. The truss system 26 also contains a plurality of slotted cut-outs 28 that run along the arrow 14 at the foot of the mattress.

The pressure point relief assembly 20 is substantially circumscribed by sidewall supports 32, 33 and 34. Foot sidewall 32 is attached to the truss system 26 perpendicular to cut outs 28 and opposite the edge of the truss system 26 abutting the perimeter of the soft strip 22, firm panels 23 and 24, and base layer 25. The foot sidewall 32 is sized and shaped such that it substantially overlaps an edge of the truss system 26. Left sidewall 33 and right sidewall 34 form respective lengthwise edges of the mattress and are in contact with respective ends of the foot sidewall 32, the truss system 26, the firm base layer 25 and respective firm panels 23 and 24. The pressure point relief assembly 20 and accompanying ridged foam side supports 32–34 are substantially covered by a top cushioning assembly 40. In a preferred embodiment, the top cushioning assembly 40 is made up of two layers of cushioning material. A semi-soft layer 44 is in direct contact with the substantially planar surface formed by the soft strip 24, firm panels 22, truss system 26, and side supports 32–34, and an ultra-soft cushioning layer 42 is then attached atop the semi-soft layer 44 to complete the mattress assembly.

The several parts of the mattress 10 are preferably made of Engineered Polymer which is a foam-like material (also known under the trade name REFLEX) proven to have greater durability and Indentation Force Deflection (IFD) versatility than conventional polyurethane foam. The components of the mattress are preferably attached using an adhesive lamination and stitching process.

In a preferred embodiment, the parts of the mattress 10 are of various thickness and firmness to provide comfortable support and pressure relief beneath areas of the body most prone to pressure sore development. Preferably, the mattress has an overall thickness of about 6 to 7 inches. Base layer 25 is approximately 2 inches thick and has an IFD rating of approximately 40 pounds. The relative firmness of this base layer ensures that heavy patients in excess of 400 pounds will not bottom out against the bed frame upon which the mattress is placed. The soft strip 22 and firm panels 23 and 24 that lay atop the base layer are also approximately 2 inches in thickness. The soft strip has an IFD rating of about 8–14 pounds while the firm panels are approximately 27–33 IFD. The firm panels 23 and 24 provide cushioning support beneath the patient along each side of the spinal column which are less susceptible to pressure sore development, while the soft strip 22 provides pressure relief beneath the vertebra and sacral areas when a patient is, for example, laying on their back. Soft strip 22 also protects the hips and shoulders when the patient is in a side-laying position.

To relieve pressure at the patient's heels, a truss system 26 is provided with an IFD rating of approximately 15–21 pounds. The truss material is about 4 inches thick to match the thickness of the combined base layer 25, soft strip 22, and support panels 23 and 24, to which the truss system 26 is fastened, which provides the supportive lift necessary for the patients heels to rest level across the horizon of the mattress and promote natural blood flow. In addition, the cut-outs 28 of the truss system 26 provide a substantial amount of open space for the heels of the patient to rest virtually pressure free.

The side supports 32–34 are made of a rigid material of approximately 60 IFD in order to provide structural support and a more stable surface from which to enter and exit the bed. These side rails are approximately 4 inches high to meet the thickness of the truss system 26, and the combined base layer 25 and firm panels 23 and 24, and soft strip 22. The top cushioning portion 40 of the mattress 10 is made of 2 layers of different firmness ratings. Layer 42 has a thickness of about ½ to ¾ inches and a firmness of about 4–10 IFD, while layer 44 is about 1¼ to 1½ inches thick and about 11–15 IFD. This combination of soft and ultra-soft top layers helps distribute body weight and shape evenly across the mattress surface to minimize interface pressure, and absorbs and cushion bony prominences of the patient's body to enhance the overall comfort of the mattress.

Obviously, numerous modifications and variations of the present invention are possible in light of the above teachings. It is therefore to be understood that within the scope of the appended claims, the invention may be practiced otherwise than as specifically described herein.

What is claimed as new and described to be secured by Letters Patent of the United States:

1. A pressure point relief system having a rectangular shape where a length of the system is longer than its width, for use in a patient resting device comprising:

at least one first foam strip having a rectangular shape where the length of the first foam strip is longer than its width, and having a predetermined firmness, the length of the first foam strip being positioned substantially parallel to the length of the system;

at least one second foam strip having a rectangular shape where the length of the second foam strip is longer than its width, and having a firmness greater than that of said first foam strip, the length of the second foam strip being positioned adjacent and parallel to the length of said first foam strip to provide a smooth transition from a surface of said first foam strip to a surface of said second foam strip, said first and second foam strips forming an upper body support region; and at least one foam truss portion positioned substantially perpendicular to the lengths of said first and second foam strips to form a lower body support region and provide a smooth transition from the surface of said first and second foam strips to a surface of said truss portion thereby forming a substantially planar surface wherein said substantially planar surface has different firmness in different areas of the planar surface which correspond to different points of the patient's body.

2. The pressure point relief system of claim 1 wherein said foam truss portion comprises a piece of foam material having a plurality of cut-outs that extend through said piece in a direction perpendicular to said planar surface.

3. The pressure point relief system of claim 1 wherein said first foam strip has a firmness of about 8–14 indentation force deflection, said second foam strip has a firmness of about 27–33 IFD and said truss system has a firmness of about 15–21 IFD.

4. A localized pressure point relief mattress comprising:

a base layer;

a pressure point relief layer attached to a top side of said base layer and having a first foam strip of a predetermined firmness centered between and in smooth surface transition with two second foam strips each having a firmness greater than that of said first foam strip, said pressure point relief layer being sized and positioned so as to be aligned with said base layer;

a truss portion abutting an edge of said aligned base layer and pressure point relief layer to form a substantially planar top surface and a perimeter;

a sidewall portion attached to and substantially circumscribing said perimeter to form a substantially planar mattress surface; and a cushion portion positioned to substantially cover said mattress surface.

5. The mattress of claim 4 wherein said foam truss portion comprises a piece of foam material having a plurality of cut-outs that extend through said piece in a direction perpendicular to said planar surface.

6. The mattress of claim 4 wherein said first foam strip has a firmness of about 8–14 IFD, said second foam strip has a firmness of about 27–33 indentation force deflection IFD and said truss system has a firmness of about 15–21 IFD.

7. The mattress of claim 4 wherein said cushion portion comprises:

an intermediate layer in direct contact with said planar surface and having a firmness of about 11–15 IFD; and a top layer attached to said intermediate layer and having a firmness rating of about 4–10 IFD.

8. The mattress of claim 4 wherein the said sidewall portion has a firmness rating of about 60 IFD.

* * * * *